US007424837B2

(12) United States Patent
Shu

(10) Patent No.: US 7,424,837 B2
(45) Date of Patent: Sep. 16, 2008

(54) QUICK SWITCH HAND TOOL

(76) Inventor: Zu-Shung Shu, No.11, Alley 11, Lane 25, Kuo CHung 1st Road, Ta Li City, Taichung Hsien (TW)

( * ) Notice: Subject to any disclaimer, the term of this patent is extended or adjusted under 35 U.S.C. 154(b) by 0 days.

(21) Appl. No.: 11/669,497

(22) Filed: Jan. 31, 2007

(65) Prior Publication Data

US 2008/0178717 A1 Jul. 31, 2008

(51) Int. Cl.
*B25G 1/08* (2006.01)

(52) U.S. Cl. ..... 81/62; 81/60; 81/177.4; 81/490

(58) Field of Classification Search ..... 81/60–63, 81/177.4, 490, 177.85, 128, 129
See application file for complete search history.

(56) References Cited

U.S. PATENT DOCUMENTS 4,627,315 A * 12/1986 Lin ..... 81/177.4
4,722,252 A * 2/1988 Fulcher et al. ..... 81/57.39
5,522,291 A * 6/1996 Liu ..... 81/490
5,927,158 A * 7/1999 Lin ..... 81/60
5,946,987 A * 9/1999 Wei ..... 81/63.2
6,101,902 A * 8/2000 Wei ..... 81/63
6,431,034 B1 * 8/2002 Chen ..... 81/177.4
6,684,738 B2 * 2/2004 Huang ..... 81/60
6,748,824 B2 * 6/2004 Chen ..... 81/60
6,752,047 B1 * 6/2004 Lee ..... 81/60

OTHER PUBLICATIONS

Taiwan Patent No. 155346, Apr. 1, 1991, 2 pages.

* cited by examiner

*Primary Examiner*—Joseph J. Hail, III
*Assistant Examiner*—Anthony Ojini
(74) *Attorney, Agent, or Firm*—Alan Kamrath; Kamrath & Associates PA

(57) ABSTRACT

A quick switch hand tool includes a base board, a plate, a shell, and a cover connected together. A driving shaft is rotatably disposed in the base board, the plate, the shell and the cover. A switch means is mounted on the base board and is provided for switching the direction of the driving shaft. A quick actuating member is disposed on the driving shaft and provides the effect of quick actuating.

21 Claims, 11 Drawing Sheets

QUICK SWITCH HAND TOOL

DESCRIPTION

1. Field of the Invention

The present invention relates to a quick switch hand tool and, more particularly, to a quick switch hand tool having switch means.

2. Description of the Related Art

Taiwan Patent No. 155346 discloses a prior wrench comprising a ratchet included on two ends thereof and provided for driving a screw. However, the prior wrench can only drive two standards screws and can not provide the effect of quickly actuating. It's not convenient for a user to carry several kinds of wrenches.

SUMMARY OF THE INVENTION

It is, therefore, the purpose of this invention to provide a quick switch hand tool including a base board, a plate, a shell, and a cover connected together. A driving shaft is disposed in the base board, the plate, the shell, and the cover. A switch means is mounted on the base board and provided for the driving shaft. A quick actuating member is disposed on the driving shaft and provides the effect of quickly actuating.

Other objectives, advantages, and features of the invention will become more apparent from the following detailed description when taken in conjunction with the accompanying drawings.

DETAILED DESCRIPTION OF THE PREFERRED EMBODIMENT

Figure 1:
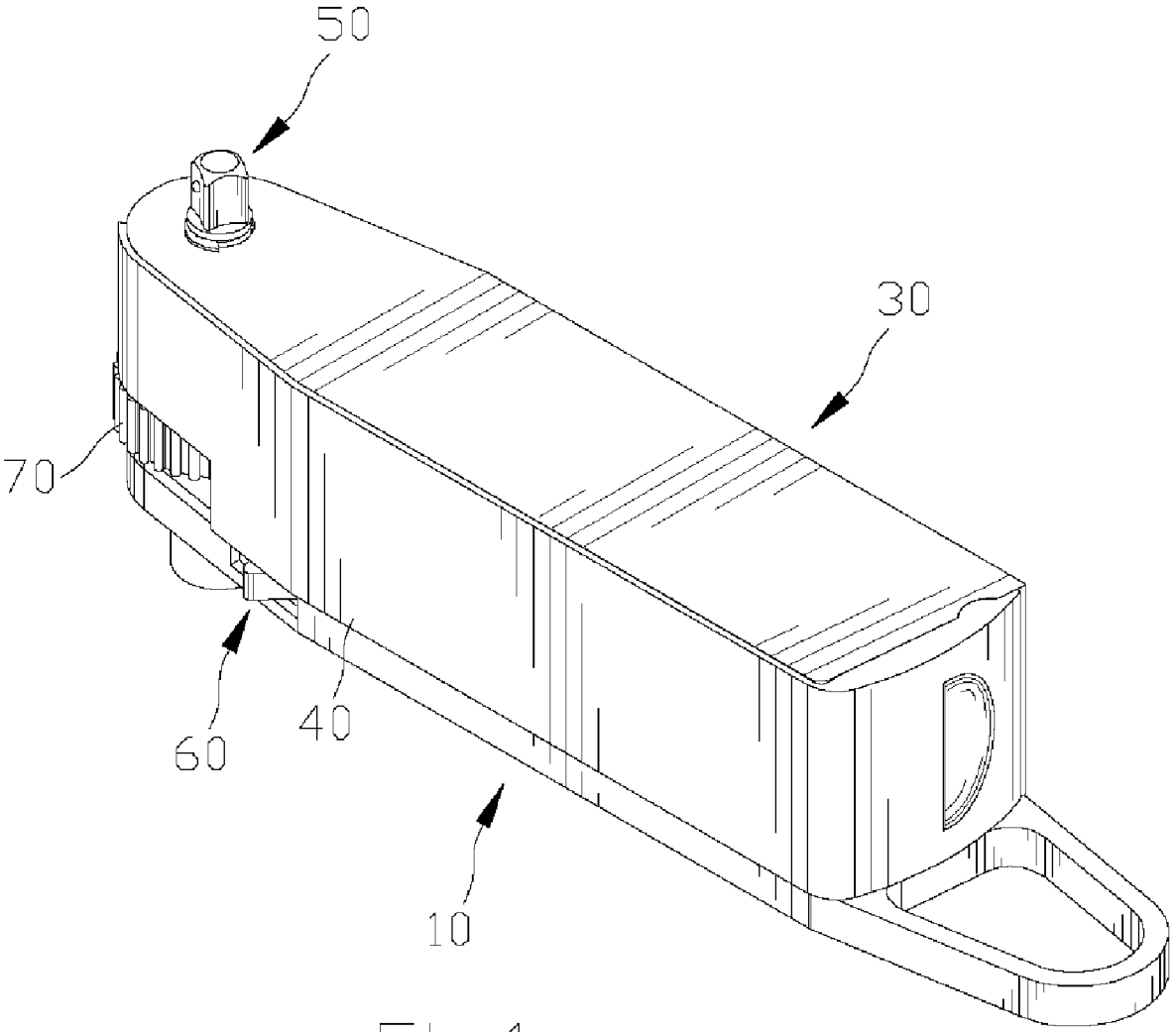
FIG. 1 is a perspective view illustrating the first embodiment of a quick switch hand tool in accordance with the present invention.
Figure 2:
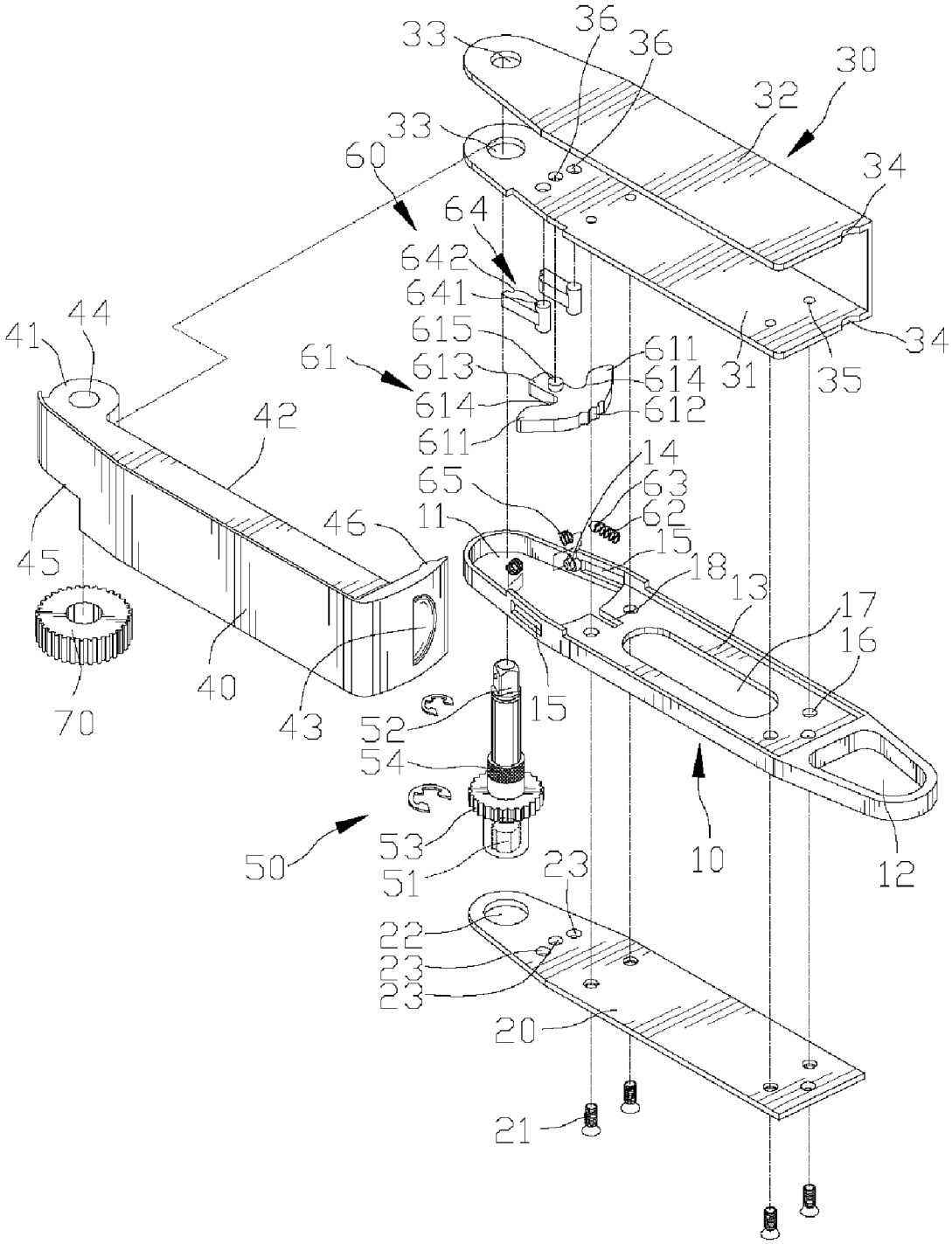
FIG. 2 is an exploded perspective view illustrating the first embodiment of a quick switch hand tool in accordance with the present invention.
Figure 3:
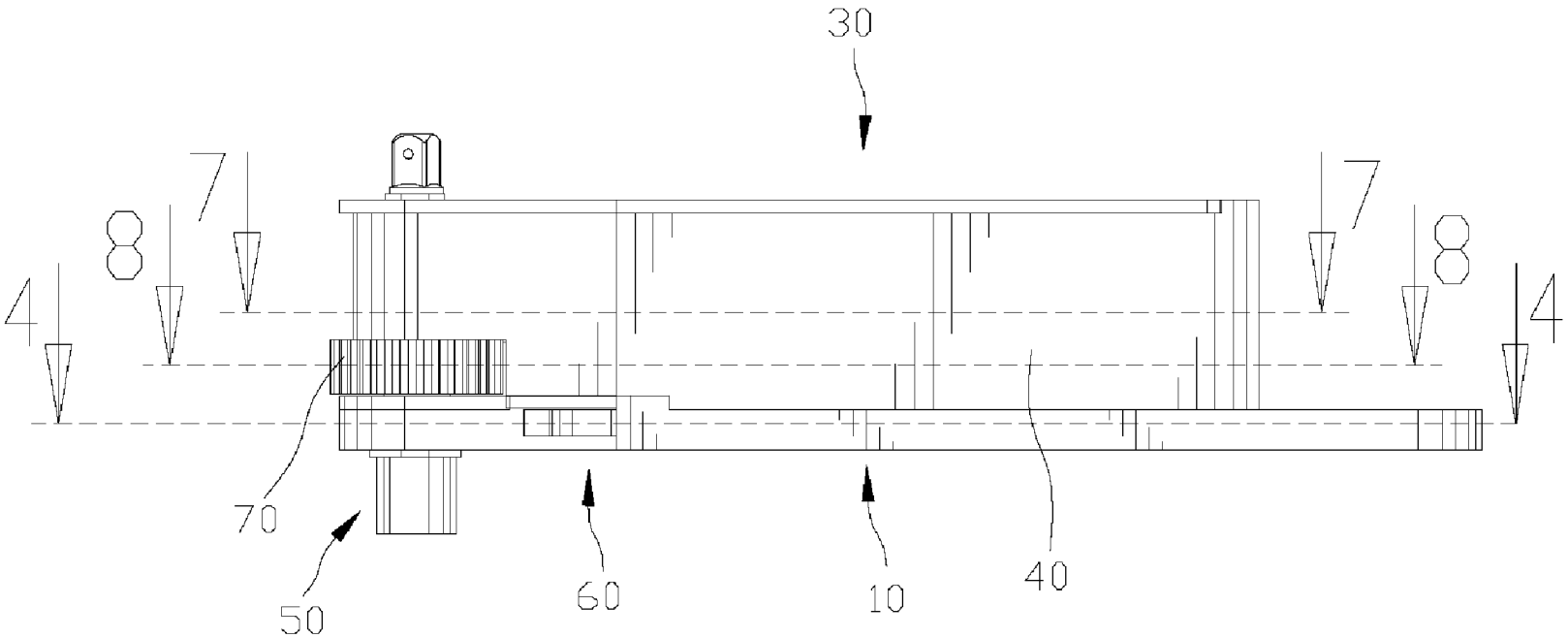
FIG. 3 is a side view illustrating the first embodiment of a quick switch hand tool in accordance with the present invention.

Referring to FIGS. 1 through 3, the first embodiment of a quick switch hand tool in accordance with the present invention comprises a base board 10, a plate 20, a shell 30 and a cover 40. A driving shaft 50 is disposed through the base board 10, the plate 20, the shell 30, and the cover 40 connected to each other. A switch means 60 is mounted on the base board 10 and is provided for the driving shaft 50 to switch the direction. A quick actuating member 70 is mounted on the driving shaft 50 and provides the effect for quick actuation.

A space 11 is formed on an end of the base board 10, and a hanging hole 12 is formed on another end thereof. A connecting portion 13 is defined between the space 11 and the hanging hole 12, and the two inside walls of the space 11 both include a protrusion 14 and a slot 15. The connecting portion 13 is thinner than the base board 10. A plurality of combining holes 16 and a through portion 17 are formed on the connecting portion 13, and a recess 18 is extended from a side of the space 11 to the connecting portion 13.

The plate 20 presses on the connecting portion 13 of the base board 10, and disposed in the combining holes 16 are a plurality of fixed elements 21. A through hole 22 and three coupling holes 23 are formed on an end of the plate 20.

The shell 30 is U-shaped and includes a base 31 and a top 32. Two through holes 33 are, respectively, formed on an end of the base 31 and the top 32, and two concavities 34 are, respectively, defined on the side of another end thereof. A plurality of fixed holes 35 are three coupling holes 36 are formed on the base 31. The shell 30 couples to the base board 10 via the fixed elements 21 of the plate 20 fixed in the fixed holes 35 through the combining holes 16 of the base board 10.

The cover 40 includes a pivot portion 41, a compartment 42 and a actuating portion 43. The pivot portion 41 in the shell 30 provides a pivot hole 44 corresponding to the through holes 33, and a concave portion 45 which is formed on a side of the pivot portion 41 exactly installs the quick actuating member 70. A protrusion 46 is formed on the actuating portion 43 corresponding to the concavities 34 of the shell 30, and the outer surface of the actuating portion 43 is hollow such that it's easy to actuate.

The driving shaft 50 extends through the through hole 22 of the plate 20, the through holes 33 of the shell 30 and the pivot hole 44 of the cover 40 and is disposed in the space 11 of the base board 10. C-clips hook the ends of the driving shaft 50 extending through hole 22 of the plate 20 and the through holes 33 of the shell 30. A driving hole 51 is defined on an end of the driving shaft 50, and a driving head 52 is formed on another end thereof. Further, the driving hole 51 is exposed from the plate 20, and the driving head 52 is exposed from the shell 30. A ratchet 53 is mounted on the driving shaft 50 near the driving hole 51 and is received in the space 11 of the base board 10. A holding portion 54, situated on the driving shaft 50 where the shell 30 is disposed on, is embossed. The quick actuating member 70 is retained on the holding portion 54 by being installed between the base 31 and the cover 40.

The switch means 60 includes a actuating member 61, an elastic portion 62, a ball 63, two actuating blocks 64 and two elastic elements 65. Two pawls 611 are formed on the two ends of the actuating member 61 and are, respectively, disposed in the slots 15 of the base board 10. A retaining portion 612 is defined next to the two pawls 611 and has three concavities. A protruding block 613 is opposite to the retaining portion 612, and two recesses 614 are, respectively, formed on the two sides of the protruding block 613. A protruding portion 615 defined on the upper surface of the protruding block 613 engages with one of the coupling holes 23 of the plate 20 and one of the coupling holes 36 of the shell 30. The elastic portion 62 is received in the recess 18 of the connecting portion 13, and the ball 63 is received between the elastic portion 62 and the retaining portion 612. The two actuating blocks 64 are disposed in the two recesses 614 on the two sides of the protruding block 613. An extending portion 641 formed on an end of the actuating block 64 is pivotally disposed in one of the coupling holes 23 of the plate 20 and one of the coupling holes 36 of the shell 30. An engaged portion 642 formed on another end of the actuating block 64 engages with the ratchet 53 of the driving shaft 50. The elastic element 65 mounts on the protrusion 14 of the base board 10 and pushes the actuating block 64.

Figure 4:
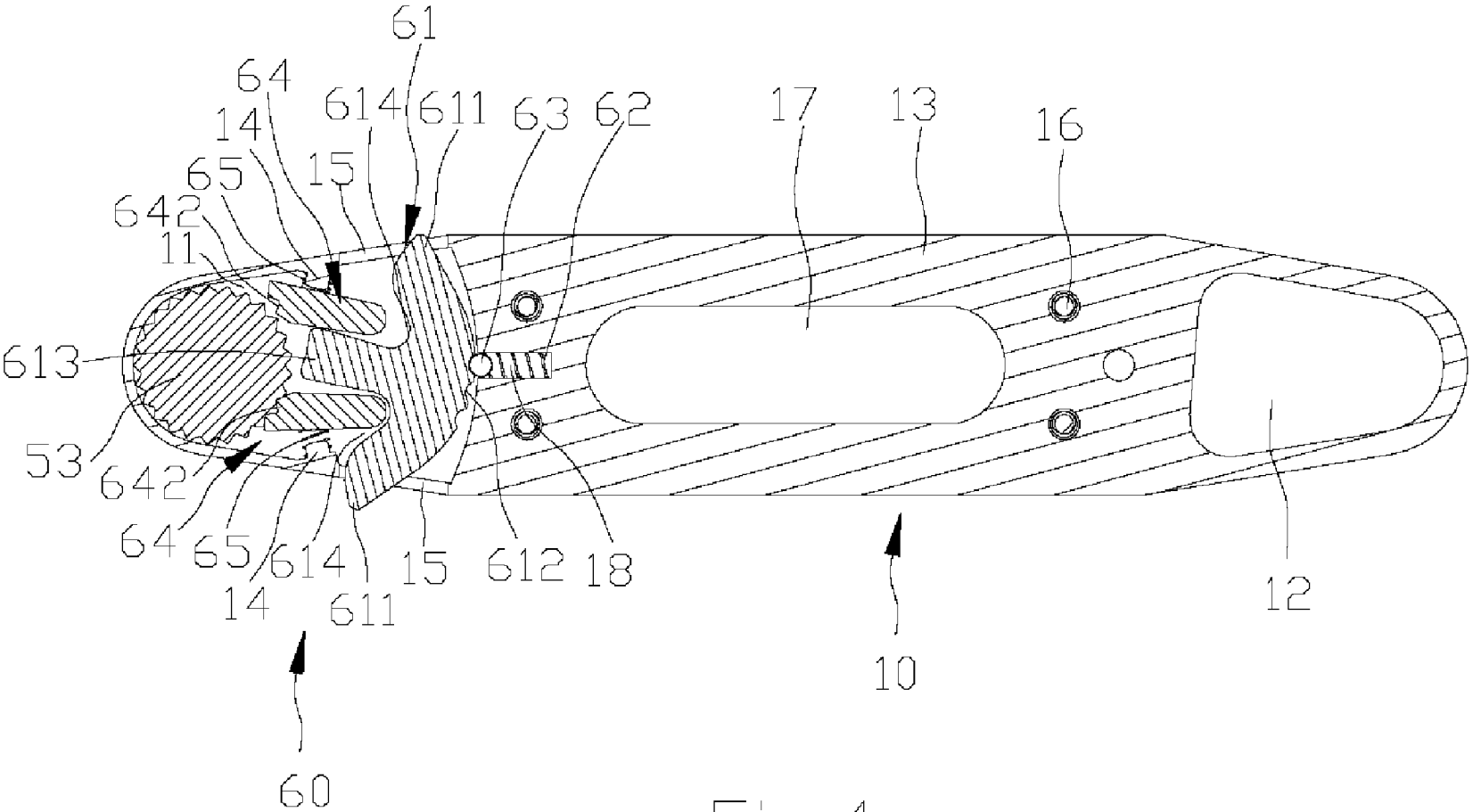
FIG. 4 is a cross-sectional view taken along plane 4-4 in FIG. 3, showing actuating the actuating member.
Figure 5:
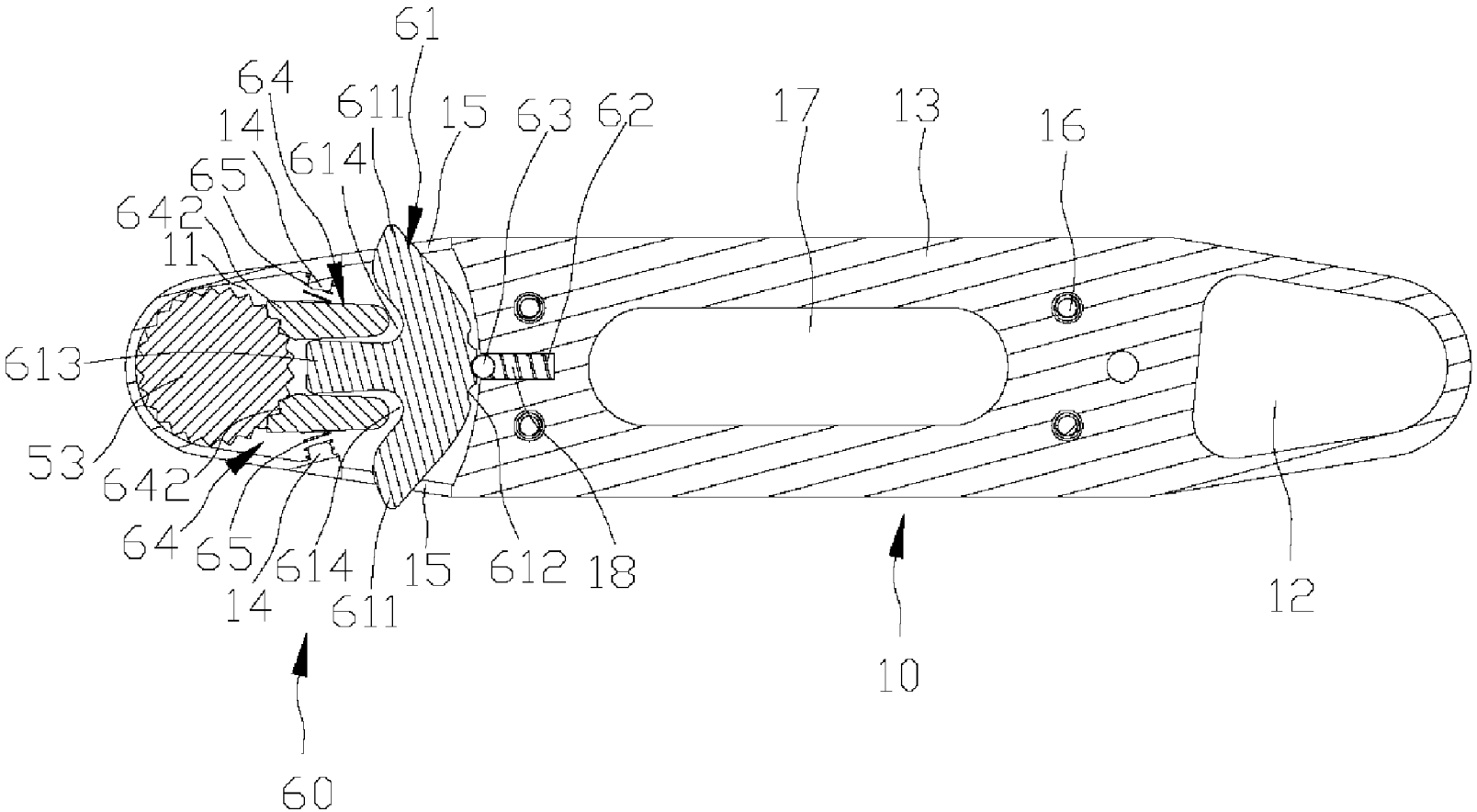
FIG. 5 is similar to FIG. 4 but shows before actuating the actuating member.
Figure 6:
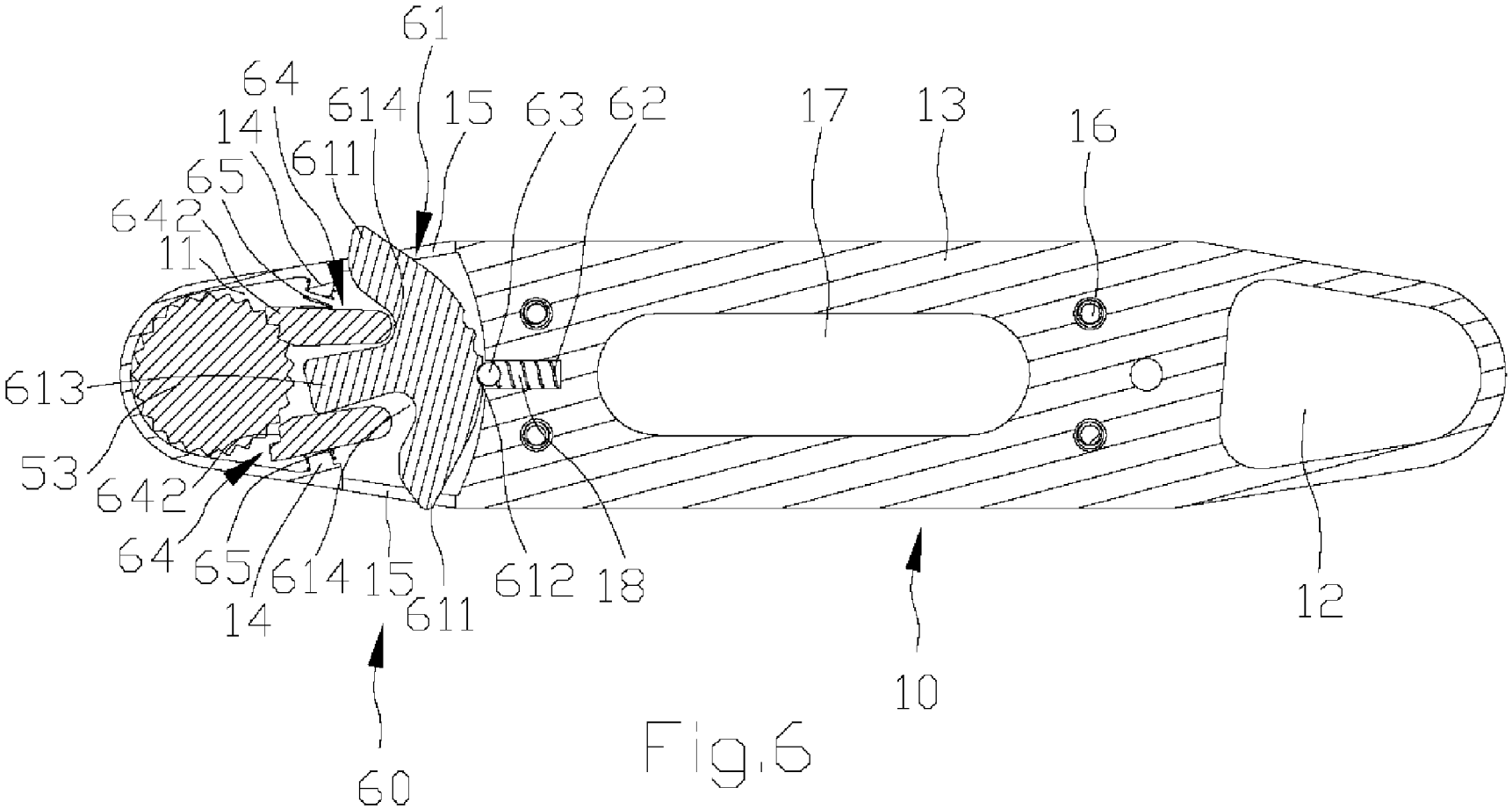
FIG. 6 is similar to FIG. 4 but shows switching the actuating member.

Referring to FIGS. 4 through 6, actuating one of the pawls 611 to move the actuating member 61 and the concavity of the retaining portion 612 near the said pawls 611 retains the ball 63. The protruding block 613 presses one of the actuating blocks 64 near the said pawl 611. There is a tolerance between the ratchet 53 and the protruding block 613. The said actuating block 64 presses the elastic element 65, and the other actuating block 64 engages with the ratchet 53.

Figure 7:
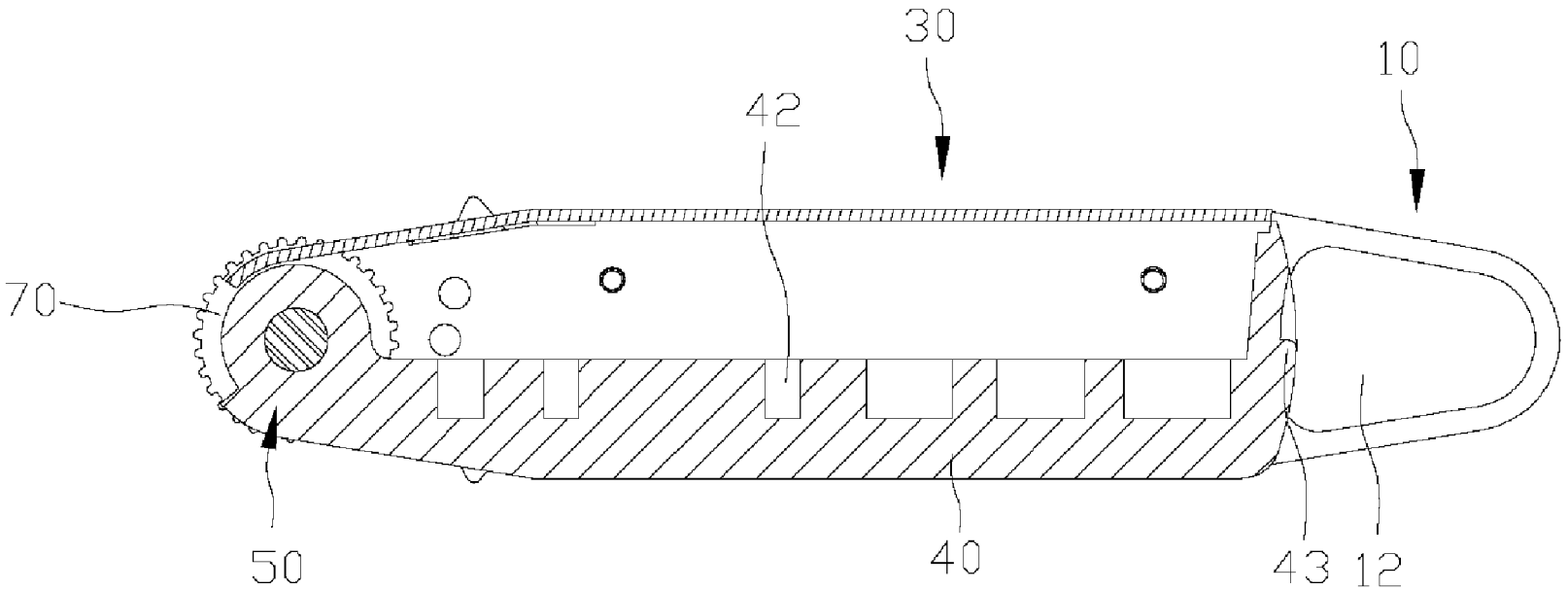
FIG. 7 is a cross-sectional view taken along plane 7-7 in FIG. 3, showing the cover pivotally installed on the shell.
Figure 8:
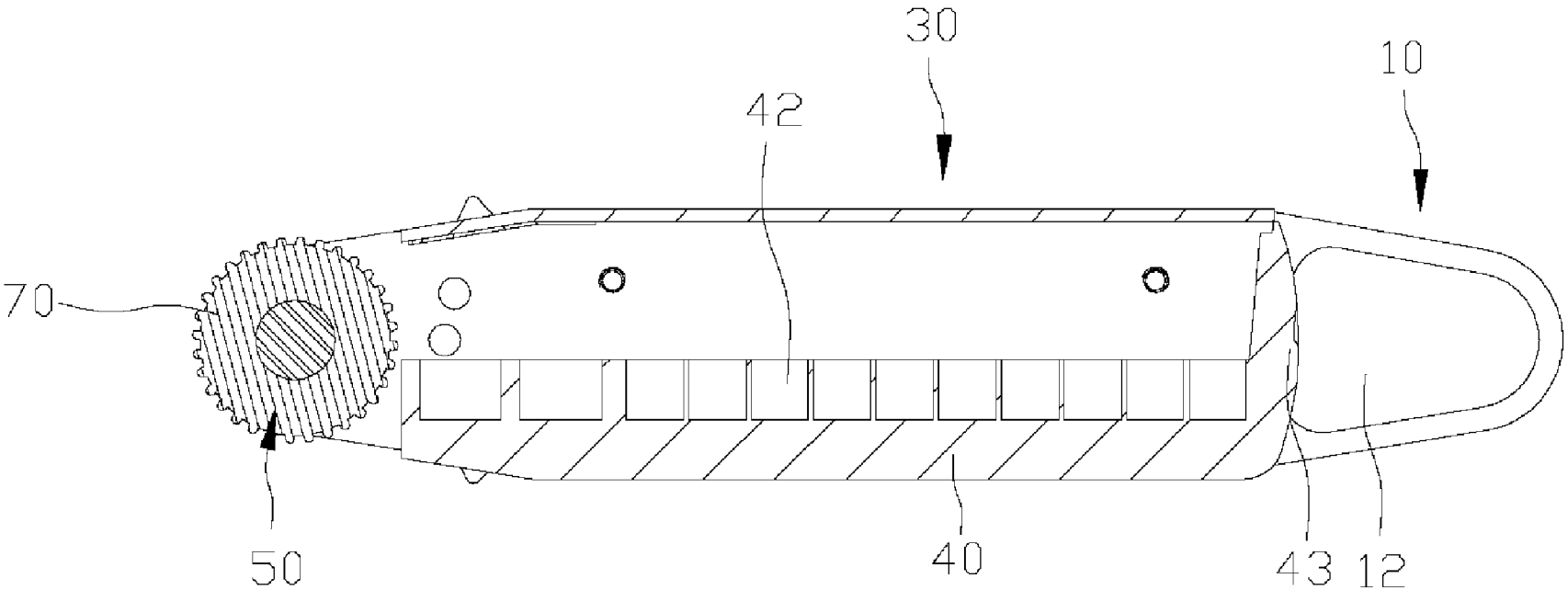
FIG. 8 is a cross-sectional view taken along plane 8-8 in FIG. 3, showing the quick actuating member.
Figure 9:
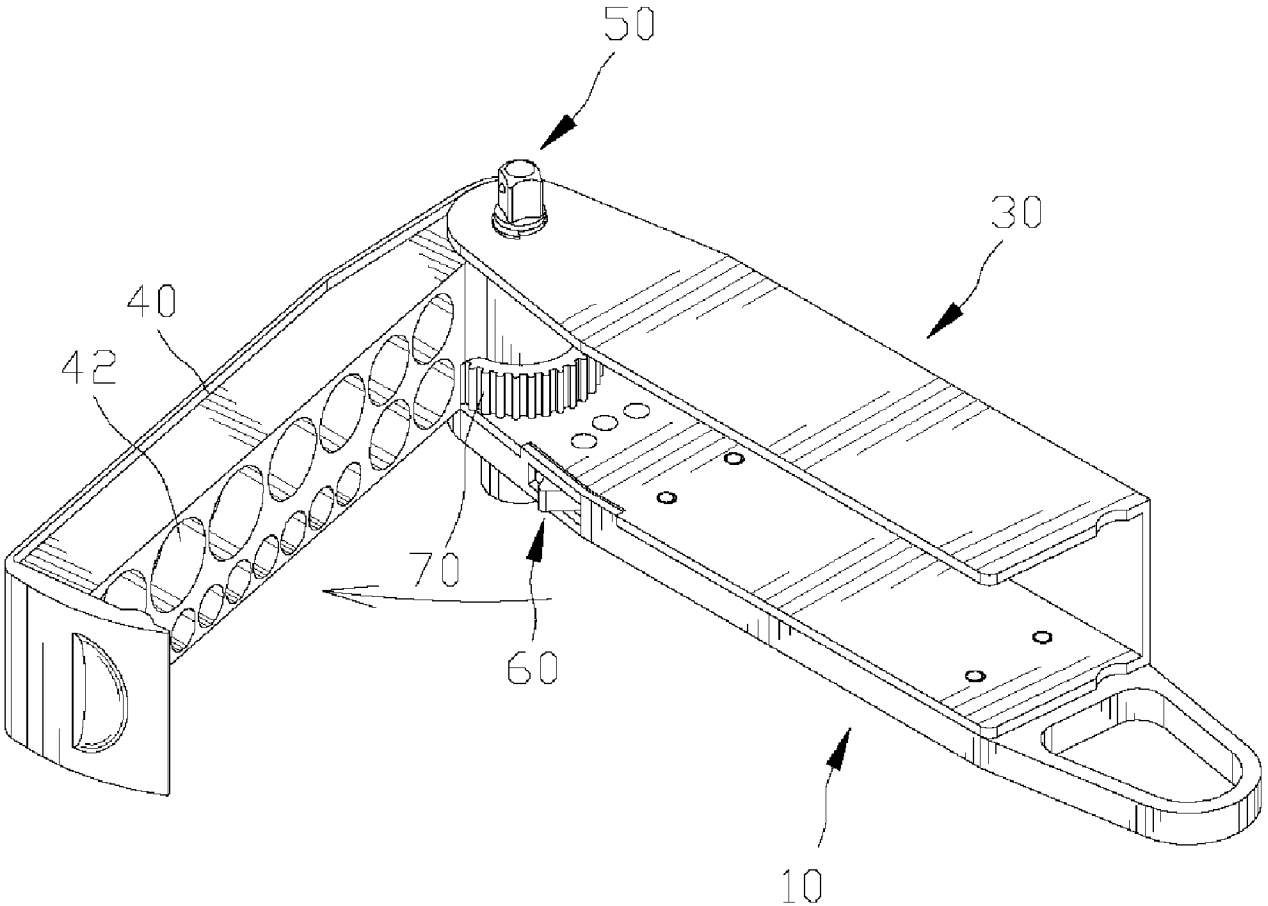
FIG. 9 is a perspective view illustrating the cover of a quick switch hand tool opened in accordance with the present invention.

Referring to FIGS. 7 through 9, the cover 40 pivotally mounts on the driving shaft 50. The driving shaft 50 is disposed in the shell 30, and the cover 40 pivotally covers the shell 30. It's easy to pivot the cover 40 via turning the actuating portion 43 of the cover 40. The compartment 42 of the shell 40 defines a plurality of holes for placing different standards of tool bits. These tool bits could be disposed in the driving hole 51 of the driving shaft 50.

The quick actuating member 70 protrudes from the shell 40 so that a user could quickly drive the driving shaft 50 to turn via the quick actuating member 70.

Figure 10:
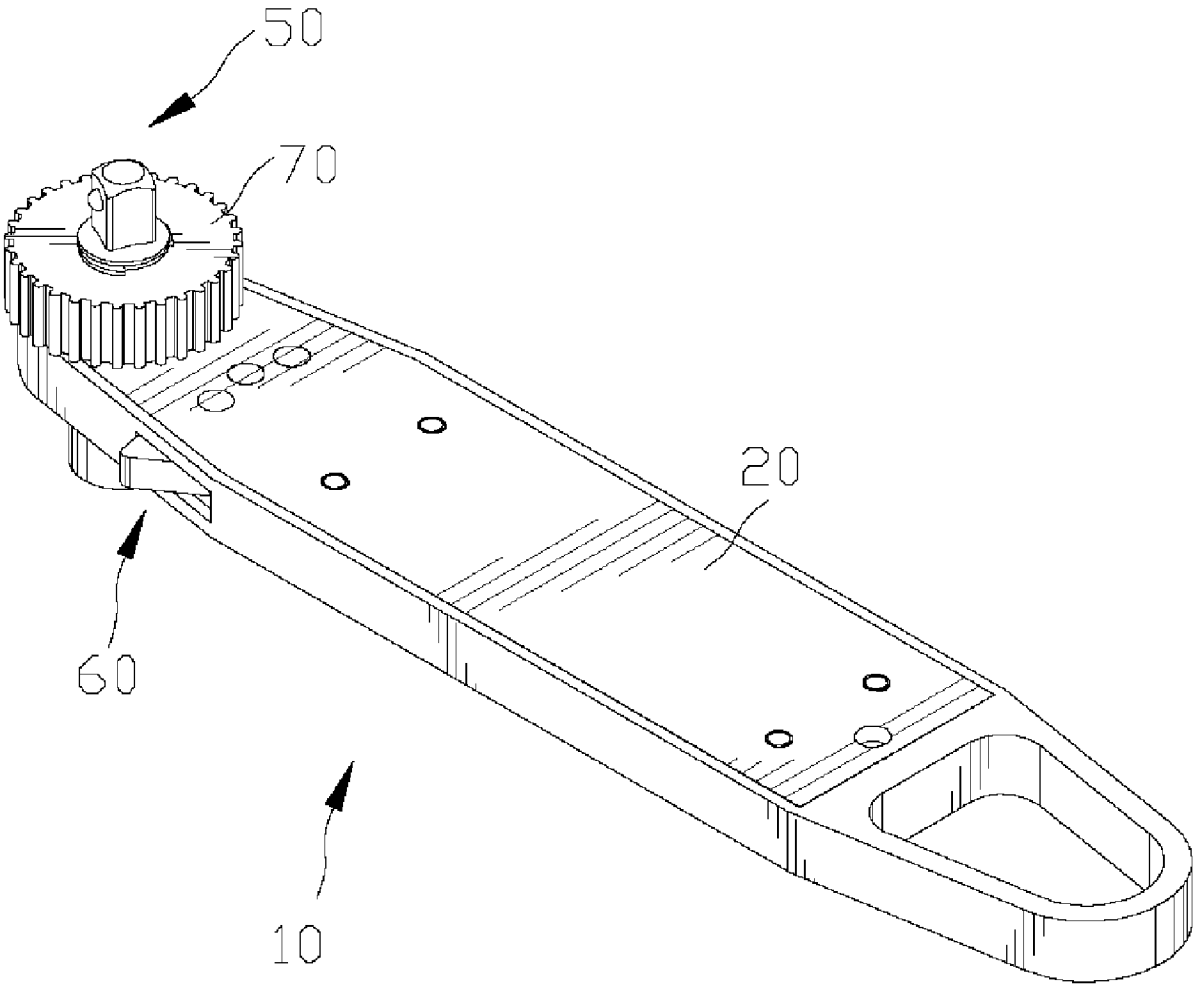
FIG. 10 is a perspective view illustrating the second embodiment of a quick switch hand tool in accordance with the present invention.
Figure 11:
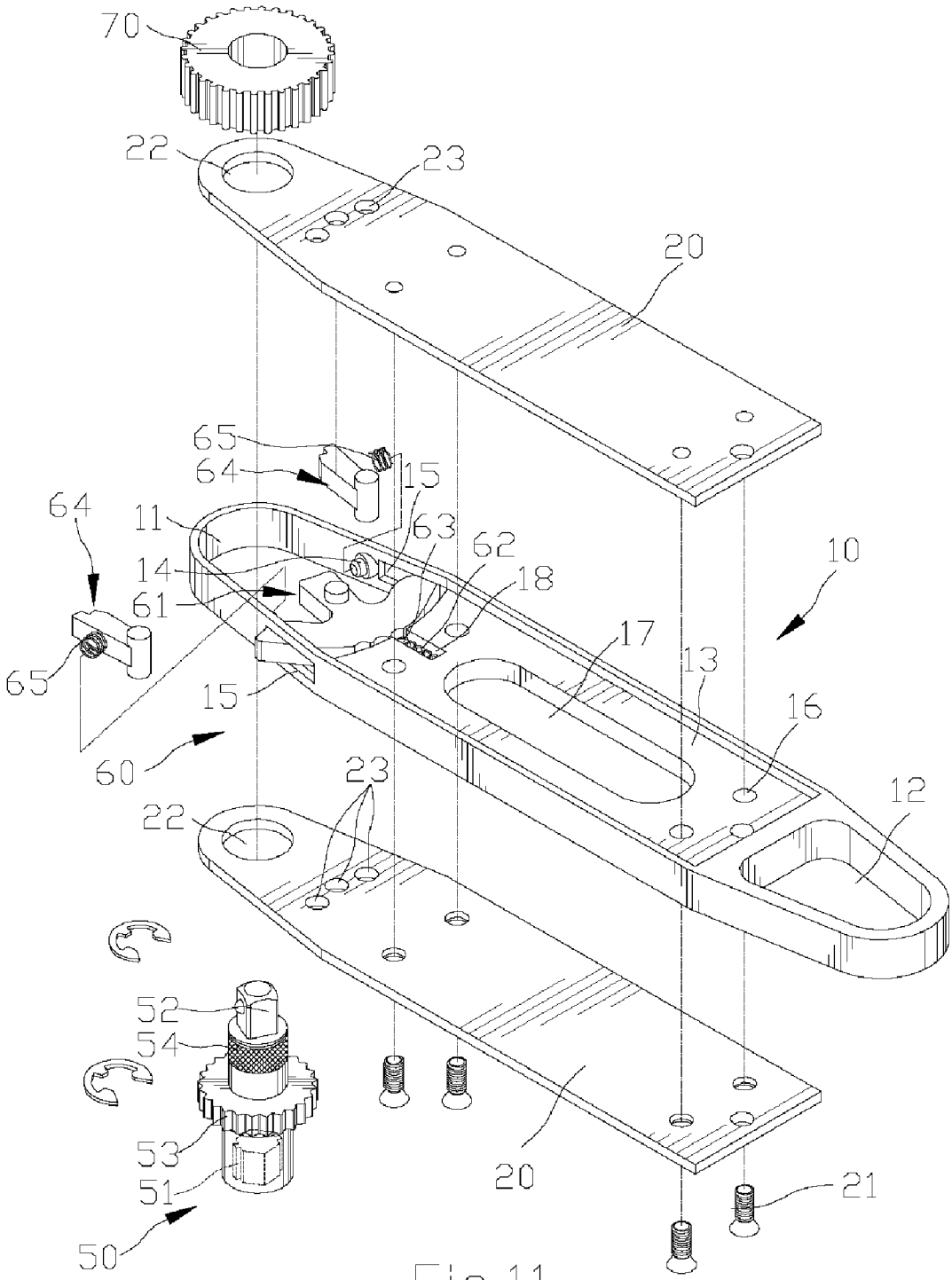
FIG. 11 is an exploded perspective view illustrating the second embodiment of a quick switch hand tool in accordance with the present invention.

Referring to FIGS. 10 and 11, the second embodiment of a quick switch hand tool in accordance with the present invention includes the base board 10, with plates 20 covering the top and the base of the base board 10. The driving hole 51 of the driving shaft 50 is exposed outside the through hole 22 of the lower plate 20, and the driving head 52 of the driving shaft 50 is exposed outside the through hole 22 of the upper plate 20. The quick actuating member 70 is disposed on the driving shaft 50 and protrudes from base board 10 so that a user could fast quickly turn the quick actuating member 70.

Summarizing the above-mentioned, the advantages of the present invention are:

1. The quick switch hand tool comprises the quick actuating member 70 providing the effect for quickly driving the screw.

2. The quick switch hand tool comprises the shell 30 including the compartment defining a plurality of holes provided for placing different standards of tool bits.

3. The quick switch hand tool comprises the switch means providing the effect for quickly switching the direction.

What is claimed is:

1. A quick switch hand tool comprising:

a base board;

a driving shaft disposed in an end of the base board, wherein the driving shaft includes a driving hole on an end thereof and a driving head on another end thereof, wherein the driving hole and the driving head respectively protrude from the plate and the shell;

a ratchet mounted on the driving shaft;

a switch means included in the base board and provided for switching direction of the driving shaft, wherein the switch means comprises an actuating member, two actuating blocks, and two elastic elements, with two ends of the actuating member respectively including a pawl protruding from the base board, with two recesses formed on the actuating member receiving the actuating blocks engaging with the ratchet, with the elastic elements pressing the actuating blocks, and with the actuating member further including a retaining portion;

a shell fixed on a side of the base board;

a cover covering the shell; and a plurality of tool bits received between the shell and the cover and for disposing in the driving shaft.

2. A quick switch hand tool as claimed in claim 1, wherein the base board defines a space, with each of two side walls of the space including a slot, with the quick switch hand tool further comprising a plate installed on another side of the base board and against the shell.

3. A quick switch hand tool as claimed in claim 2, wherein the base board includes a protrusion near the slot, with an elastic element mounted on the protrusion.

4. A quick switch hand tool as claimed in claim 2, wherein the base board includes a connecting portion near the space.

5. A quick switch hand tool as claimed in claim 4, wherein a recess extends from a side of the space to the connecting portion and receives an elastic portion and a ball.

6. A quick switch hand tool as claimed in claim 1, wherein the retaining portion has three concavities.

7. A quick switch hand tool as claimed in claim 1, wherein a wall of the actuating member includes a protruding portion, with a coupling hole formed on the shell and the protruding portion mounted in the coupling hole.

8. A quick switch hand tool as claimed in claim 1, wherein an end of the two actuating blocks forms an engaged portion engaging with the ratchet and another end of the two poke blocks defines an extending portion, with two coupling holes formed on the shell, and with the extending portion mounted in the coupling holes.

9. A quick switch hand tool as claimed in claim 1, wherein an end of the cover forms a concave portion receiving the quick actuating member.

10. A quick switch hand tool as claimed in claim 1, wherein the shell is U-shaped and covers the cover.

11. A quick switch hand tool as claimed in claim 1, wherein an interior of a compartment of the cover defines a plurality of holes.

12. A quick switch hand tool as claimed in claim 11, wherein the plurality of holes receives the plurality of tool bits.

13. A quick switch hand tool as claimed in claim 1, wherein an actuating portion is formed on an end of the cover opposite to the driving portion.

14. A quick switch hand tool as claimed in claim 1, wherein the cover covers the shell, and the cover is pivotally disposed relative to the shell on the driving shaft.

15. A quick switch hand tool comprising:

a base board including a space, and two side walls of the space respectively defining a slot;

a plate including a through hole, with the plate installed on a side of the base board and the through hole corresponding to the space;

a driving shaft disposed in the space of the base board and including a driving hole on an end thereof and a driving head on another end thereof, wherein the driving hole and the driving head respectively protrude from the base board and the plate;

a ratchet mounted on the driving shaft;

switch means received in the space of the base board, wherein the switch means comprises an actuating member, two actuating blocks, and two elastic elements, with two ends of the actuating member respectively including a pawl protruding from the slot of the base board, with two recesses formed on the actuating member receiving the actuating blocks engaging with the ratchet, and with the elastic elements pressing the poke blocks; and a quick actuating member mounted on the driving shaft, protruding from the plate and for turning the driving shaft.

16. A quick switch hand tool as claimed in claim 15, wherein the base board includes a protrusion near the slot, with an elastic element mounted on the protrusion.

17. A quick switch hand tool as claimed in claim 15, wherein the base board includes a connecting portion near the space.

18. A quick switch hand tool as claimed in claim 17, wherein a recess extends from a side of the space to the connecting portion and receives an elastic portion and a ball, and a retaining portion formed on the poke member corresponding to the ball.

19. A quick switch hand tool as claimed in claim 18, wherein the retaining portion has three concavities.

20. A quick switch hand tool as claimed in claim 15, wherein a wall of the actuating member includes a protruding portion, wherein a coupling hole is formed on the shell, with the protruding portion mounted in the coupling hole.

21. A quick switch hand tool as claimed in claim 15, wherein an end of the two actuating blocks forms an engaged portion engaging with the ratchet and another end of the two actuating blocks defines an extending portion, with two coupling holes formed on the shell, and with the extending portion mounted in the coupling holes.

* * * * *